United States Patent [19]

Nilsson

[11] 4,399,924

[45] Aug. 23, 1983

[54] CAP

[75] Inventor: Erling I. Nilsson, Trastvägen, Sweden

[73] Assignee: Tetra Pak Developpement SA, Pully-Lausanne, Switzerland

[21] Appl. No.: 296,215

[22] Filed: Aug. 25, 1981

[30] Foreign Application Priority Data

Aug. 26, 1980 [SE] Sweden ..... 8005957

[51] Int. Cl.[3] ..... B65D 51/20; B65D 51/22

[52] U.S. Cl. ..... 220/257; 220/258; 220/270; 220/307

[58] Field of Search ..... 220/257, 258, 270, 307

[56] References Cited

U.S. PATENT DOCUMENTS 4,243,152 1/1981 Ignell ..... 220/307 X

*Primary Examiner*—George T. Hall

*Attorney, Agent, or Firm*—Burns, Doane, Swecker & Mathis

[57] ABSTRACT

The invention relates to a cap for containers intended for the keeping of pressurized contents. The cap has two parts, joined along a tearing indication. The two parts along their lower edge zones, are bridged by a disc of gastight aluminum foil, adapted so that it is torn up along an annular rupture line when the cap is opened.

13 Claims, 4 Drawing Figures

CAP

BACKGROUND AND SUMMARY OF THE PRESENT INVENTION

This invention relates to closures for containers, and particularly to caps which seal a pouring channel and after opening are retained connected to the container.

In the packaging of pressurized contents a need exists to provide a cap which in the first instance is tight with respect to gases which are wholly or partially dissolved in the contents, in particular carbon dioxide. The cap should, secondly be mechanically so stable that it is retained without substantial deformation in the opening of the container. Thirdly, the cap should be relatively easy to open, and lastly be inexpensive to manufacture and easy to apply to the container.

The use has been known for a long time of screw caps, stopperlike caps of the cork type, and tear-off metal caps, in connection with bottles and other containers intended for pressurized contents. In particular for non-returnable containers of plastics it has been found, however, that the available known cap constructions are not satisfactory, largely because of the elasticity of the plastic material. Thus it is difficult simply to use a stopper construction, the simplest variety of which is an ordinary bottle-cork, since contrary to a metal container or a glass container the mouth of a plastic container under the effect of pressure tends to yield elastically, so that a stopperlike cap is easily pushed out by the internal pressure prevailing in the container. The same is the case with tear-off metal caps of the known type, since the fitting of such caps requires a certain backing from the container mouth, and this backing as a rule is not present to a sufficient extent on thin-walled plastic containers. So-called screw caps have been used for the closing of plastic containers intended for pressurized contents, but such closures are relatively expensive, since the moulding of threads on the opening part of the plastic container is burdensome to perform and in any case diminishes the capacity in the manufacture of the containers. To solve this technical problem it has been suggested previously to use an injection moulded plastic cap of the same type in principle as that of the present application, this cap being adapted so as to be used in containers whose opening part has an inwardly directed, flexible, annular lip of plastic material. Such a cap in principle consists of two parts which, however, are joined before the cap is opened along a thin, readily breakable, annular portion. To allow the said portion to be easily breakable, it is necessary that the wall thickness within the portion in question should be small, and this in turn means that the gas permeablility will be great, especially if the material itself is not particularly gastight (e.g. polyethylene). To solve this problem while retaining at the same time the advantages of the known cap, it has been proposed in accordance with the present invention to provide a cap which is characterized in that the lower, preferably plane part of the stopperlike part is provided with an annular portion projecting from the stopperlike part, whose free edge is mainly located in the same plane as the lower edge zone of the outer part. The lower edge zone of the outer part as well as the said free edge of the annular portion of the stopperlike part are jointly covered by and fixed to a circular metal foil disc.

In a preferred embodiment of the present invention the lower part of the outer tubular body is provided with an annular recess, whose diameter coincides with or slightly exceeds the diameter of the circular aluminium foil disc. The disc is adapted so that it is accomodated with its edge portion in the said recess. In a further embodiment the metal foil disc is coated on either side with a thermoplastic material, this coating layer in the edge zone of the metal foil disc being pressed out a little with the help of heat and pressure over the edge zone of the metal foil disc and induced to combine together by fusion, encapsulating at the same time the cut edge zone of the metal foil disc.

The invention will be described in the following with reference to accompanying drawings wherein

BRIEF DESCRIPTION OF THE DRAWINGS

FIG. 1*a* is an enlarged view of a portion of FIG. 1.

FIG. 2*a* is an enlarged view of a portion of FIG. 2.

DETAILED DESCRIPTION OF THE PREFERRED EMBODIMENTS

Figure 1:
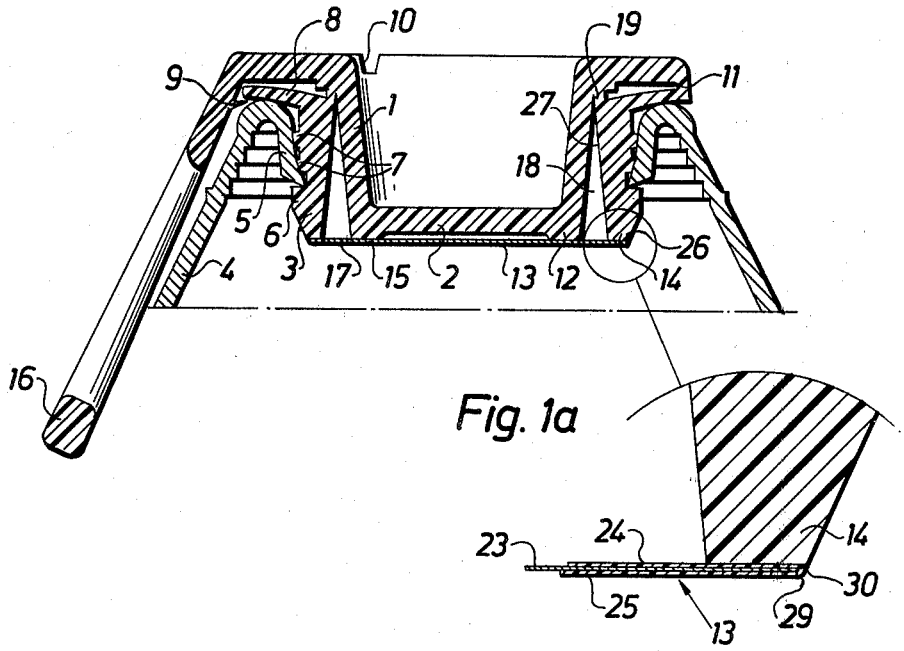
FIG. 1 is a cross-sectional view of a cap in accordance with a first preferred embodiment of the present invention which is inserted in a container opening.

With reference now to FIG. 1, a cap of a type in accordance with the invention is fitted into a container 4 which has an opening whose mouth portion comprises an annular, inwardly directed lip 5. The container 4 can be made of glass, plastics or sheet metal and can be of optional shape with the exception of the inwardly directed lip 5.

The cap is made of an elastic material, preferably a thermoplastic such as polyethylene, and the most rational method for the manufacture of the cap consists in the application of a so-called injection moulding process.

The cap is a single coherent plastic part having an outer tubular body 3 and an inner stopperlike part 1. The outer tubular body 3 is provided in its lower part with a hooklike flange 6 and in its upper part with a flexible flange 8 which is larger than the flange 6. On the outside of the tubular body 3 between the said flanges 6 and 8 sealing devices in the form of flexible, deformable sealing elements or projections 7 are arranged. An inside 27 of the tubular body 3 is adapted so as to form a pouring channel for the pouring out of the contents of the container 4 and the inside 27 may suitably be made slightly tapering so as to facilitate the manufacturing process of the cap. The inner, stopperlike part 1 can also be made with slightly tapering side walls and a suitable angle of inclination is 4°.

The stopperlike part 1, moreover, has a base 2 and a projecting portion 12 joined to the base 2 whose free end surface is designated 15. The stopper part 1 is joined along the thin and easily breakable circular portion 19 to the upper part of the tubular body 3, and it is also joined to the outer part of the flange 8 along a short connecting zone 11. The connecting zone 11 is situated opposite a gripping part 16 with a pull-ring, this gripping part being connected to a part of the edge zone of the flange 8. For the fastening of the stopperlike part 1 on the tubular body 3 after the connection 11 has been broken up, the gripping part 16 is provided with a catch 9 known in itself which is adapted so that it engages under the flange 8. The tubular body 3 and the projecting annular portion 12 of the stopperlike part 1 are in principle arranged with their lower edges in the same plane and are joined to one another by a gastight disc 13, preferably of aluminium foil, which disc bridges the space 18 between the tubular body 3 and the part 1. To facilitate the fixing of the disc to the lower part 14 of the tubular body 3 and to the free surface 15 of the annular portion 12, the aluminium foil disc 13 is provided with a coating which has good adhesion to the aluminium foil disc 13. The coating of the foil disc 13 can be made to fix onto the cap along the surfaces 14 and 15, preferably through the application of heat with simultaneous exertion of pressure. Such a coating preferably may be constituted of a polyethylene layer, but it is also conceivable to use a so-called hot-melt, that is to say a melting glue or a hot-sealable varnish. Since the aluminium foil material is chemically attacked by acids which occur e.g. in fruit juices, it is necessary in certain cases to coat both sides of the aluminium foil disc 13 with thermoplastic material.

Owing to the concentric, annular fixing surfaces 14 and 15 for the aluminium foil disc 13 being relatively narrow, the energy required for the sealing operation can be substantially reduced.

If the area of the unsupported part 17 of the aluminium foil disc 13 is too large, the forces emanating from the pressure inside the container 4 onto this part of the disc 13 will become so great that the disc 13 can burst. This is a problem, especially within the area 17, since the volume of the wedge-shaped compressible space 18 is relatively large, whereas the problem does not arise to any appreciable extent in the central, unsupported portion of the aluminium foil disc 13, as the distance between the base 2 of the cap and the disc is small (approx. 0.5 mm) and the compressible volume of the space behind the disc 13 is consequently small.

It has been found that the thickness of the disc has to be adapted to the size of the area 17, and for containers with an opening diameter of 20–25 mm it has been possible to establish empirically that the ratio A between the inside diameter of the lower part of the tubular body 3 and the outside diameter of the annular portion 12 of the stopperlike part 1 should be between 1.2 and 2, preferably 1.25. Moreover, it has been possible to establish that the thickness T of the aluminium foil ought to be between 5 and 25μ, T having to be at least $5+10\,xA$ with a tolerance of ±25%. Naturally any plastic coatings on the aluminium foil disc 13 will also to a certain extent contribute to its strength. However, the effect is not so great insofar as the occurrence of bursts in the aluminium foil is concerned, since the plastic material of the coating layers has a completely different modulus of elasticity from the aluminium material. This means that at a relatively small extension the aluminium foil disc 13 may already break, before the plastic coating, owing to its greater elasticity, has been able to make any significant contribution to the rupture strength of the aluminium foil disc.

The rules concerning the thickness of the aluminium foil given here are intended only to serve as a guideline in the dimensioning of the disc 13, and the dimensioning may be modified within relatively wide limits, taking into account such factors as the pressure in the container, the quality of the aluminium foil, the diameter of the container mouth etc.

After the filling of the container 4 with the intended contents, e.g. beer or carbonated fruit juice (so-called lemonade) the cap is pressed into the opening of the container, the lower tapered portion 26 of the outer tubular part 3 facilitating the guiding and introduction of the cap into the container mouth. As the cap is pressed in, the lower flange of the tubular body 3 will be pressed past, and, thanks to its flexibility, will snap over the lower edge of the inwardly directed lip 5 of the container 4 the same time, the upper flange 8 of the tubular body 3 will come to rest against the upper edge of the container mouth in such a manner that the inwardly directed lip 5 is firmly fixed between the flanges 3 and 8, simultaneously, the outside of the lip 5 is pressed against the corresponding sealing element 7 of the cap. It is assumed that the container 4 is manufactured from a material of good gas barrier properties, in particular with regard to oxygen and carbon dioxide, e.g. glass, sheet metal or a relatively gastight plastic material, such as acrylonitrile plastic of the type which is marketed under the trade name BAREX or polyester (possibly with PVC coating).

As mentioned earlier it is most appropriate to injection-mould the cap in polyethylene material, which material unfortunately has, relatively speaking, poor gas barrier properties, and an injection-moulded polyethylene cap of the type shown in FIG. 1 causes large gas losses, especially along the thin, tearable portion 19, if the cap is not provided with any gastight cover disc 13. However, if a disc 13 of aluminium foil is fitted on the cap in the manner which has been specified, the gas leakage through the cap can be radically restricted and the contents in the container 4 are better protected against deterioration of quality, or in other words the shelf life of the package can be extended.

When the contents in the container are to be made accessible to the consumer, the gripping part 16 is pulled upwards and pried over the mouth of the container in that it is "folded" along the straight weakening groove 10 which is arranged transversely across the cap. Owing to the upper part of the cap being folded or brought down over the groove 10, the "forces for prying open" are concentrated on that part of the breakable portion 19 which is situated between the gripping part 16 and the groove 10, which means that the initial tearing up of the portion 19, which taken by itself requires force, is made easier. When the portion 19 has been torn up or broken up as far as the groove 10, the remaining part of the portion 19 is easily torn up at the same time as the disc 13 of aluminium foil is made to burst in the unsupported area 17, and the stopperlike part 1 is removed out of the emptying channel of the container which is formed by the inside of the annular part 3 remaining in the container mouth.

Owing to the part 1 being attached "hingelike" to the annular body 3 along the portion 11, the part 1 is not removed as an undesirable object of scrap, but can instead function as a guide to assist when the container is to be reclosed. This is made possible in that the inner part of the gripping part 16 is provided with a catch 9 which is adapted so that it can engage under the flange and retain the torn-up stopperlike part 1 in closing position. As mentioned, the aluminium foil disc 13 has to be protected in certain cases from making contact with the contents, because the taste of the contents may be affected by the metal and also because the metal foil disc may be eaten away by acids occurring in the contents. In these cases it is often not sufficient to coat the aluminium foil disc 13 with an outer protective layer of plastics, but the free edges or cut edges of the aluminium foil layer, which in general are exposed when the aluminium foil discs are punched out of a sheet or weblike material, must also be protected.

Figure 2:
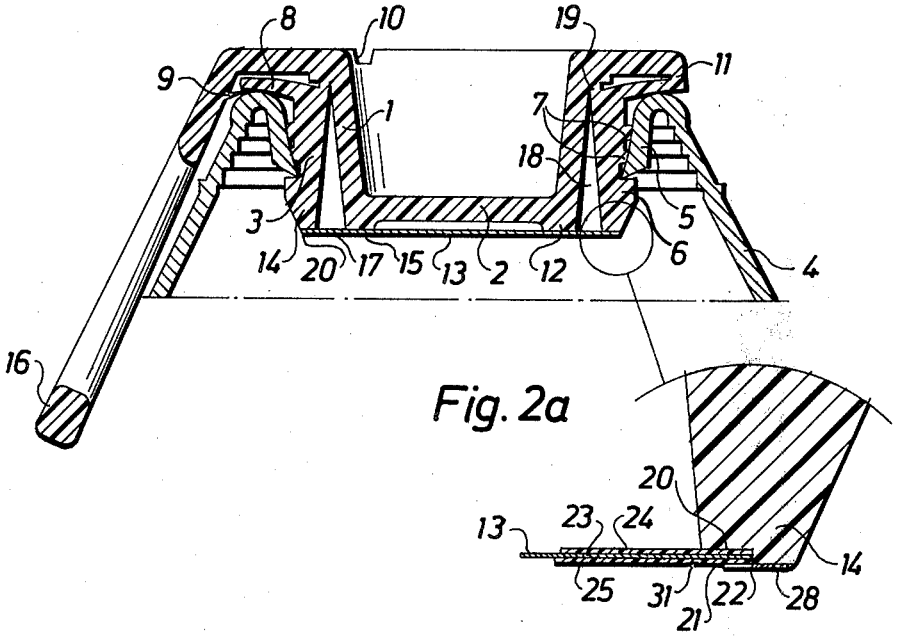
FIG. 2 is a cross-sectional view of a second preferred embodiment of the present invention with the sealing disc of metal foil being fitted into an annular recess.

A proposed solution of this technical problem is shown in FIG. 2 and 2*a* (an enlargement of the ringed portion of FIG. 2). Apart from certain modifications of the cap in the area of the fixing of the aluminium foil disc 13 it is for the rest wholly in accordance with the description given earlier, and, for the sake of clarity, the same reference numerals to the drawing have been used in FIG. 2 and 2*a* as in FIG. 1.

With reference now to FIG. 2 and FIG. 2*a*, the lower portion of the tubular part 3 has been provided with an annular recess 20, whose depth is at least as great as the thickness of the gastight disc 13. In the case illustrated here that thickness comprises a central layer of aluminium foil 23 and outer coats 24 and 25 of thermoplastics. During the punching operation, the disc 13 has been given such a dimension that it can be inserted with its edge portion 21, with a relatively good fit, into the recess 20. In the fixing or sealing operation the foil disc 13 is pressed with simultaneous heating of the edge portion 21, (e.g. by means of high-frequency heating) against the inside of the recess 20. When this is done the plastic material 24, which may be constituted of polyethylene material, is fused together with the plastic material on the inside of the recess 20 so as to obtain a tight and mechanically durable joint. At the same time plastic material is heated and pressed out from the lower part 28 of the annular body over the inner edge of the recess 20 and the edge zone of the disc 13, so that a thin plastic layer 22 bridges the edge zone of the disc 13 and is made to fuse together tightly with the outer plastic layer 25 of the disc 13. In the manner described the aluminium foil layer 23 of the disc 13 can thus be completely encapsulated and protected from contact with the contents.

It has been found, that at least in caps which have been subjected to pressure from pressurized contents over a prolonged period, the disc 13 is made to burst close to where it is fixed in the stopperlike part 1 when the cap is torn up. This is in general quite desirable, since a stopper part is obtained in this manner which is free from "flash" or projecting remains of the disc 13 when the stopperlike part 1 is withdrawn from the emptying channel. If desired, however, it is possible to direct the rupture line in the disc 13 by providing one or both of the plastic layers 24 or 25 with an incision or weakening line 31.

In FIG. 1*a* is shown a further variation of a method for protecting the cut edge 29 of the aluminium foil disc 23. It is assumed that the aluminium foil disc 23 in FIG. 1*a* is covered on both sides with a coating of thermoplastic material 24 and 25 (e.g. polyethylene). The plastic layer 24 is sealed in the manner as described previously to the underside of the annular body 3 in the region 14. In accordance with FIG. 1*a*, the cut edge 29 of the aluminium foil disc 23 is protected by heating the edge portion of the gastight disc 13 in conjunction with the sealing operation. The plastic coatings 24 and 25 in the edge zone of the disc are thereby made to melt and are caused by means of a compression jaw to flow out over the cut edge 29 of the aluminium foil disc 23 so that the latter is wholly "baked in" or enclosed along the whole of its perimeter by the edge portions of the coatings 24 and 25 joined to one another in the area 30 by fusion. It is possible to achieve this effect because under the influence of heat the plastic material can be pressed out easily over the edge of the aluminium foil disc 23, whereas the aluminium foil layer itself is not deformed.

By the use of the cap disclosed in the present invention, the gas tightness of known caps can be greatly improved while the price of the function and the cap are not affected to any appreciable degree.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention.

What is claimed is:

1. A closure for the mouth of a container comprising:

an outer body having a central opening forming a pouring channel, said outer body including first sealing means for engaging and sealing said outer body in the mouth of a container, said outer body having an annular surface at one end thereof;

an inner body adapted to be received within the central opening of said outer body, said inner body having an annular surface at one end thereof, the respective annular surfaces of said outer and inner bodies being substantially aligned;

a gas-tight disc extending across said annular surfaces of said outer body and said inner body; and second sealing means for sealing said annular surfaces to said disc, said disc having a coating on the side opposite said annular surfaces whereby when said closure is inserted in a container, said disc prevents gas from escaping through said closure and said disc does not come in contact with the contents of said container.

2. The closure of claim 1 wherein said outer body and said inner body are integral.

3. The closure of claim 1 wherein said inner body includes:

a stopper portion adapted to be received within said pouring channel;

a flange at the end opposite said one end, said flange overlapping said outer body;

hinge means connecting said flange with said outer body; and a gripping part connected to said flange and located opposite said hinge means.

4. The closure of claim 3 wherein said inner body has a slightly tapered shape with a side angle exceeding 4'.

5. The closure of claim 1 wherein a ratio between an inside diameter of a lower part of said outer body and an outside diameter of an annular portion of said inner body is between 1.2 and 2.

6. The closure of claim 1 wherein said disc is aluminum foil and has a thickness of between 5 and 25 microns, whereby said disc prevents seepage of gas from the container into the space between said inner body and said outer body and removing said inner body from said outer body tears said disc to allow the contents of the container to be poured through said central opening.

7. The closure of claim 6 wherein said thermoplastic material is polyethylene.

8. The closure of claim 6 wherein a weakening line is arranged in said thermoplastic material coating said aluminum foil disc, said weakening line being along a desired rupture line.

9. The closure of claim 1 wherein a lower portion of said outer body is provided with an annular recess whose diameter approximately coincides with a diameter of said disc, with said disc being adapted so as to be accomodated with its edge portion in said recess and wherein said edge portion of said disc is enclosed in said recess by deformation of a lower edge portion of said outer body, said lower edge portion being pressed in over said edge portion of said disc in conjunction with the joining of said disc to said outer body.

10. The closure of claim 6 wherein both sides of said aluminum foil are disc coated with thermoplastic material, said thermoplastic coatings being joined together in an edge zone of said aluminum foil disc by fusion in such a manner that a cut edge of said aluminum foil disc is enclosed by said joined thermoplastic coatings.

11. The closure of claim 3 wherein said inner body further includes a catch, and wherein after said inner body has been torn from said outer body and lifted from the mouth portion of container to open the container, said inner body can then be reinserted in said pouring channel of said outer body with said catch being adapted so as to engage under said upper flange of said outer body and retain said inner body in a closing position.

12. A cap for a mouth portion of a container for pressurized contents, the mouth portion having an annular inwardly directed lip, said caps comprising:

a tubular outer body of plastic having a central opening forming a pouring channel, said outer body including on an outer periphery thereof a plurality of flexible sealing projections and a plurality of flanges for holding, in a gastight manner, said outer body on the mouth portion of the container, said outer body having an annular surface at a lower end thereof;

a stopper-like inner body of plastic integral with said outer body and inserted into said pouring channel, said inner body being connected to said outer body along a readily breakable annular zone, said inner body having an annular surface at a lower end thereof; and a disc of metal foil adhered to said annular surfaces of said outer body and said inner body to prevent a seepage of gas from said container to a space between said outer body and said inner body before said inner body is torn from said outer body thereby also tearing said disc, said metal foil disc having a coating of thermoplastic material on the side of said disc opposite said annular surfaces to prevent contact between said metal foil disc and the contents of the container.

13. The cap of claim 12 wherein a lower portion of said outer body is provided with an annular recess in which said disc is accommodated with a lower edge portion of said annular recess being pressed in over said disc to retain said disc in correct position.

* * * * *